US006956598B2

(12) United States Patent
Fujiwara

(10) Patent No.: US 6,956,598 B2
(45) Date of Patent: Oct. 18, 2005

(54) LASER INTENSITY ADJUSTING METHOD

(75) Inventor: Kensuke Fujiwara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/280,518

(22) Filed: Apr. 5, 1999

(65) Prior Publication Data

US 2003/0058332 A1 Mar. 27, 2003

(30) Foreign Application Priority Data

Apr. 20, 1998 (JP) ..... 10-109782

(51) Int. Cl.[7] ..... B41J 2/435
(52) U.S. Cl. ..... 347/246; 347/236
(58) Field of Search ..... 347/131, 133, 347/251, 236, 237, 240, 246, 247, 253, 252; 358/300, 458, 459, 461, 3.24; 399/127, 51, 399/48, 32, 128, 39, 49

(56) References Cited

U.S. PATENT DOCUMENTS 5,071,723 A * 12/1991 Koyama et al. ..... 430/58
5,274,424 A * 12/1993 Hattori et al. ..... 399/49
5,406,390 A * 4/1995 Mizoguchi ..... 358/3.24
5,548,320 A * 8/1996 Yamanaka et al. ..... 347/246
5,737,665 A * 4/1998 Sugiyama et al. ..... 399/39
5,913,092 A * 6/1999 Bisaiji et al. ..... 399/49
5,966,558 A * 10/1999 Kikui ..... 399/44
6,104,986 A * 8/2000 Arevalo ..... 702/120

FOREIGN PATENT DOCUMENTS

JP 4-255874 * 9/1992 ..... G03G 15/04
JP 10-63046 * 3/1998 ..... G03G 15/00
JP 10-73975 * 3/1998 ..... G03G 15/00

* cited by examiner

*Primary Examiner*—Hai Pham
(74) *Attorney, Agent, or Firm*—Smith, Gambrell & Russell LLP

(57) ABSTRACT

A method of adjusting the maximum intensity of a laser exposure mechanism for irradiating laser light to the surface of a photoreceptor to which a uniform potential is being given by a corona discharger. Photoreceptor surface portions are exposed to laser lights of a plurality of laser intensities obtained by coarsely dividing an optional laser intensity, and the potentials of the photoreceptor surface portions are detected (coarse-division potential detecting step). In the vicinity of the laser intensity corresponding to the potential closest to the desired preset potential, the predetermined laser intensity is further finely divided to set a plurality of laser intensities, photoreceptor surface portions are exposed to laser lights of the plurality of laser intensities thus set, and the potentials of the photoreceptor surface portions are detected (fine-division potential detecting step). The fine-division potential detecting step is repeated until there is obtained potential equal to or substantially equal to the desired preset potential, and there is set, as the maximum intensity, the laser intensity corresponding to the potential thus obtained.

7 Claims, 6 Drawing Sheets

LASER INTENSITY ADJUSTING METHOD

BACKGROUND OF THE INVENTION

1. Field of the Invention

The present invention relates to a laser intensity adjusting method to be applied to an electrophotographic digital image forming apparatus of a digital copying apparatus, a digital printer or the like. More specifically, the present invention relates to a laser intensity adjusting method of adjusting the maximum intensity of laser light for irradiating the photoreceptor presenting a uniform potential given by the corona discharger, such that the potential of a photoreceptor portion exposed to laser of the maximum intensity is equal to a predetermined set potential.

2. Description of Related Art

In an image forming apparatus of a digital copying apparatus or the like, there is conducted, regularly or as necessary, a so-called potential correction for making correction such that the potential of the photoreceptor surface is equal to a predetermined value. The potential correction includes a so-called dark potential correction and a so-called residual potential correction. The dark potential correction refers to correction in which, with the photoreceptor not exposed to laser, the potential is corrected by adjusting the bias voltage of the grid of the corona discharger. The residual potential correction refers to correction in which, with the photoreceptor exposed to laser, the potential is corrected by adjusting the maximum intensity of the laser light. Generally, residual potential correction is to be conducted in succession after dark potential correction.

FIG. 4 schematically illustrates the arrangement of an image forming apparatus A of a color digital copying apparatus, in the vicinity of the photoreceptor thereof.

The image forming apparatus A has at its center a drum-like photoreceptor 1. Disposed around the photoreceptor 1 are a corona discharger 2 for giving a predetermined uniform potential to the surface of the photoreceptor 1, a laser exposure unit 8 (of which laser light is shown by an arrow of L) for causing a surface portion of the photoreceptor 1 to be exposed to the laser light based on an image read by an image reading device (not shown), a potential sensor 3 for measuring the surface potential of the photoreceptor 1, developing units 4*a*–4*d* for developing an electrostatic latent image on the surface of photoreceptor 1 formed by its exposure to the laser light of the laser exposure unit 8 (the developing units 4*a*–4*d* arranged to respectively form toner images of yellow, cyanogen, magenta and black), a transferring belt 5 for transferring, to transfer paper, the toner images on the photoreceptor 1 surface formed by the developing units 4*a*–4*d*, and a cleaning unit 6 for cleaning residual toner remaining on the photoreceptor 1 surface. These component elements above-mentioned are disposed in this order in the rotational direction of the photoreceptor 1 or in the direction of an arrow Y1.

The following description will discuss the operational procedure of dark potential correction and residual potential correction with reference to FIGS. 5 and 6.

At the dark potential correction (Step S51), the bias voltage of the grid of the corona discharger 2 is set to an optional value, and the potential (dark potential) of the photoreceptor 1 surface is measured by the potential sensor 3 with the photoreceptor 1 not exposed to the laser exposure unit 8. Based on a difference between the measured dark potential and the desired preset potential, using a relationship equation (linear equation) obtained through experiments or the like, the bias voltage is adjusted such that the dark potential is equal to the desired preset potential. The dark potential correction is relatively readily conducted in the manner above-mentioned because the relationship between the grid bias voltage and the surface potential of the photoreceptor 1 can be approximated using a substantially straight line function.

In succession, residual potential correction is to be conducted on the photoreceptor 1 which has just been subjected to dark potential correction. The maximum intensity of the laser exposure unit 8 is set to an optional value (for example 1 in FIG. 6), and then the surface of the photoreceptor 1 presenting a uniform potential given by the corona discharger 2 is exposed to the laser light of the laser exposure unit 8 (Steps S52 and S53). Then, the potential (residual potential) of the photoreceptor 1 surface is measured by the potential sensor 3 (Step S54). A linear equation (3 in FIG. 6) previously obtained through experiments or the like is then applied to the measured residual potential (2 in FIG. 6) to calculate the laser intensity (5 in FIG. 6) for the desired preset potential (4 in FIG. 6) (Step S56). The laser intensity thus obtained is set as the maximum intensity (Step S57), and the operations of steps S53–S57 are repeated until the residual potential obtained at the step S54 becomes substantially equal to the desired preset potential (Step S55).

The foregoing conventional residual potential correction is disadvantageous in view of much labor and time required. More specifically, according to the conventional residual potential correction, the solution is searched using a linear equation previously obtained through experiments or the like. However, the actual relationship between laser intensity and residual potential is as shown in FIG. 6, and it is therefore difficult to linearly approximate this relationship. Thus, although the laser maximum intensity is gradually converged to the solution by repeating the steps S53–S57, repeated operations are required in a large number of iteration times before the final solution is obtained.

SUMMARY OF THE INVENTION

It is an object of the present invention to provide a laser intensity adjusting method capable of readily making a residual potential correction in a shorter period of time.

The present invention provides a laser intensity adjusting method of adjusting the maximum intensity of a laser exposure unit for irradiating laser light to the photoreceptor surface to which a uniform potential is being given by a corona discharger, such that the potential of the photoreceptor portion exposed to laser of the maximum intensity is equal to a predetermined preset potential. According to the present invention, photoreceptor surface portions are exposed to laser lights of a plurality of laser intensities obtained by coarsely dividing a predetermined laser intensity, and the potentials of the photoreceptor surface portions exposed to the laser lights of the plurality of laser intensities are detected (coarse-division potential detecting step). In the vicinity of the laser intensity corresponding to the potential which is the nearest to the predetermined set potential, out of the potentials detected at the coarse-division potential detecting step, the predetermined laser intensity is further finely divided to set a plurality of laser intensities, photoreceptor surface portions are exposed to laser lights of the plurality of laser intensities thus set, and the potentials of the photoreceptor surface portions exposed to the laser lights of the plurality of laser intensities are detected (fine-division potential detecting step) The fine-division potential detecting step is repeated until there is obtained potential equal to or substantially equal to the predetermined set potential, and there is set, as the maximum intensity, the laser intensity corresponding to the potential thus obtained.

According to the laser intensity adjusting method of the present invention, photoreceptor surface portions are exposed to laser lights of a plurality of laser intensities obtained by coarsely dividing an optionally set laser intensity, and the potentials of the photoreceptor surface portions are detected. When there is not obtained the desired preset potential, there are repeated operations of exposing photoreceptor surface portions to laser lights of a plurality of further finely divided laser intensities and, detecting the respective potentials, until there is obtained potential equal to or substantially equal to the predetermined set potential. Thus, no adjustment is made with the use of approximation, but the whole adjustment is made based on actually measured values, enabling an accurate residual potential correction to be readily made with a less number of iteration times.

These and other features, objects and advantages of the present invention will be more fully apparent from the following detailed description set forth below when taken in conjunction with the accompanying drawings.

DESCRIPTION OF THE PREFERRED EMBODIMENTS

The following description will discuss an embodiment of the present invention for better understanding thereof. It is however noted that the following embodiment is a mere example embodying the present invention, and does not limit, in nature, the technical scope thereof.

Figure 1:
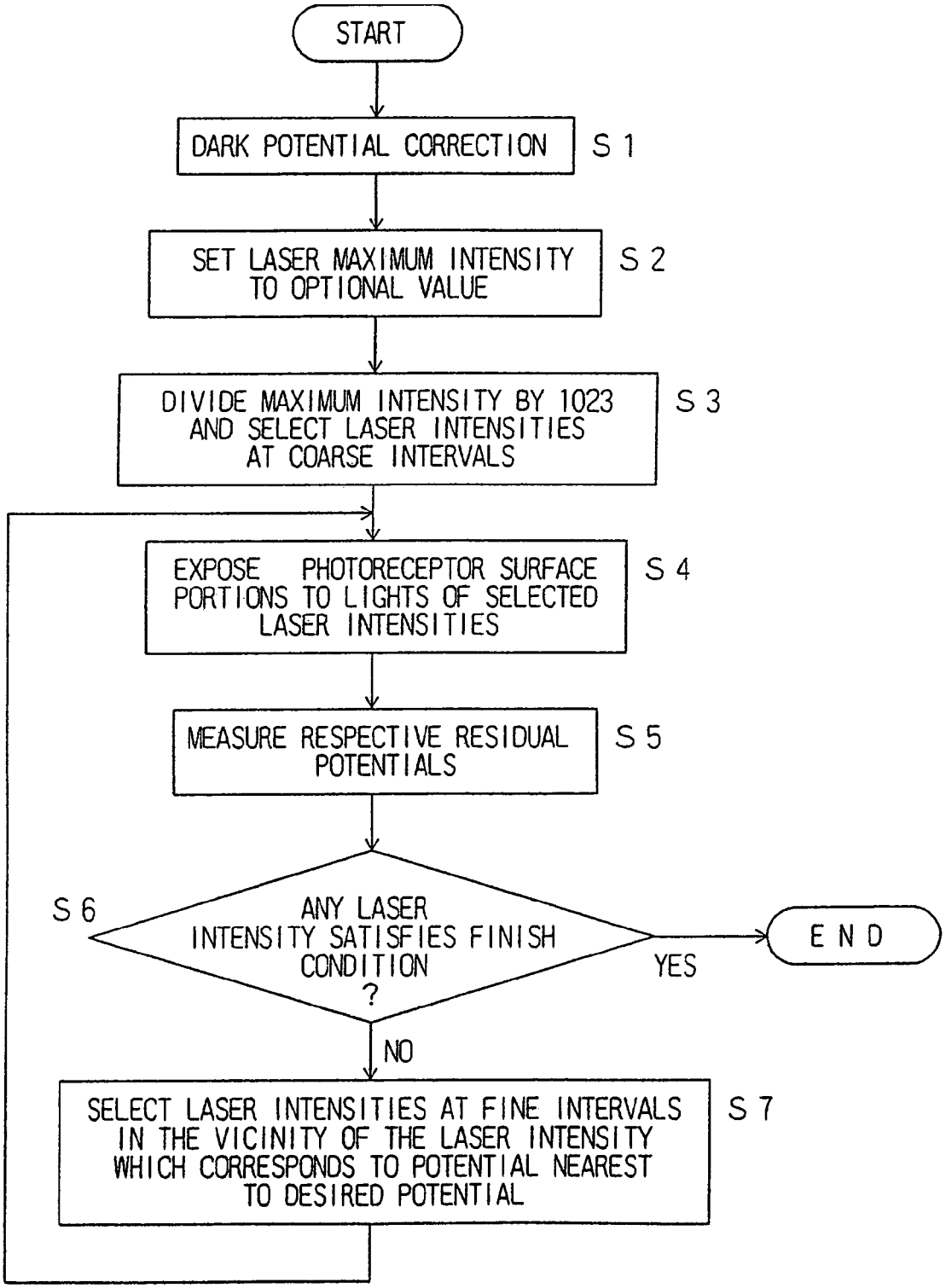
FIG. 1 is a flow chart illustrating a laser intensity adjusting method according to an embodiment of the present invention.
Figure 2:
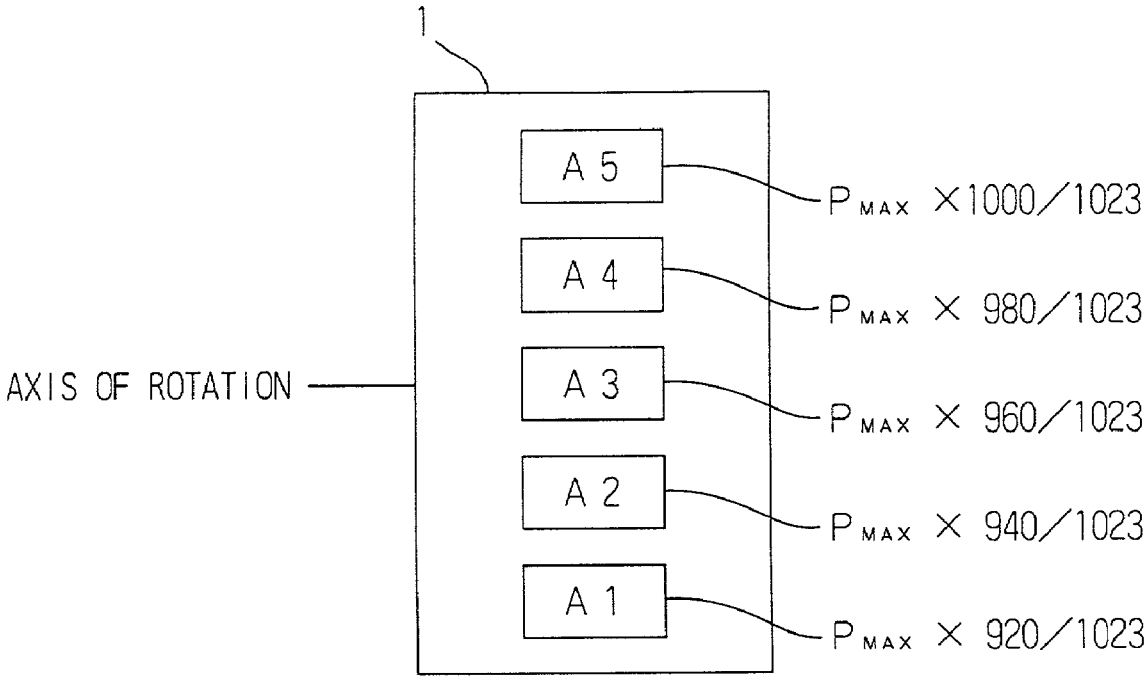
FIG. 2 is a view illustrating an example of exposure portions (patches) formed on the photoreceptor.
Figure 3:
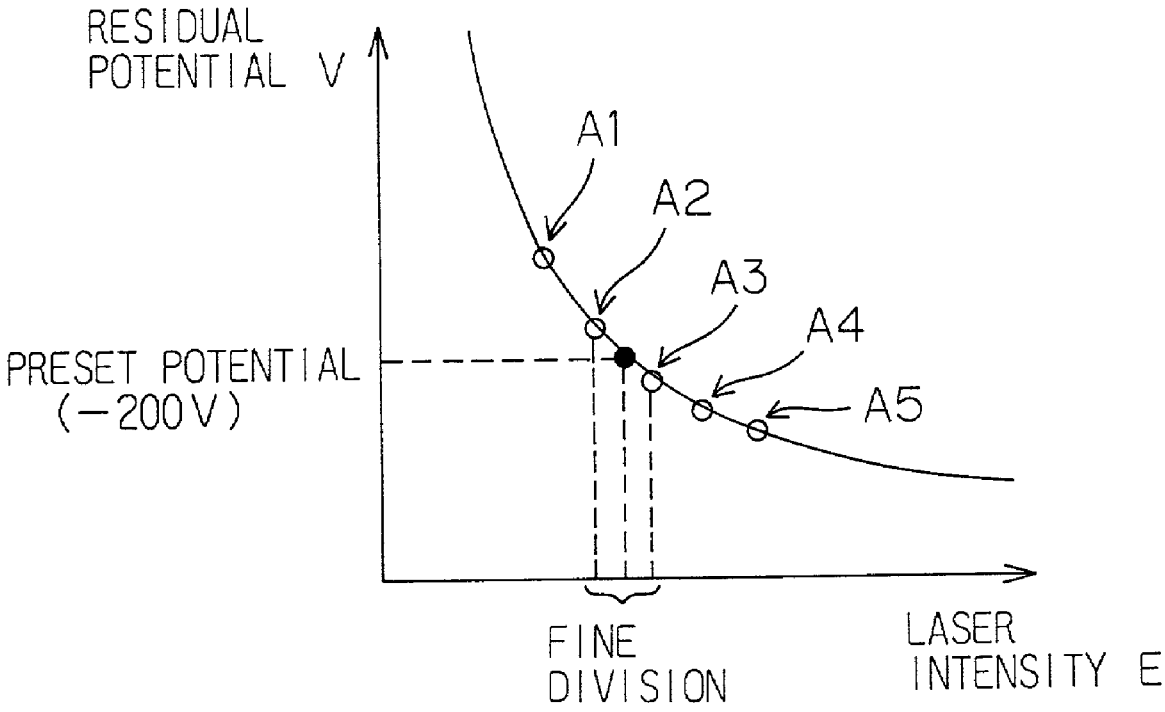
FIG. 3 is a view illustrating the residual potential correction operation according to the embodiment of the present invention.

FIG. 1 is a flow chart illustrating a laser intensity adjusting method according to an embodiment of the present invention; FIG. 2 is a view illustrating an example of exposure portions (patches) formed on the photoreceptor; FIG. 3 is a view illustrating a residual potential correction operation according to the embodiment of the present invention; and FIG. 4 is a side view schematically illustrating the arrangement of an image forming apparatus A of a color digital copying apparatus.

Figure 4:
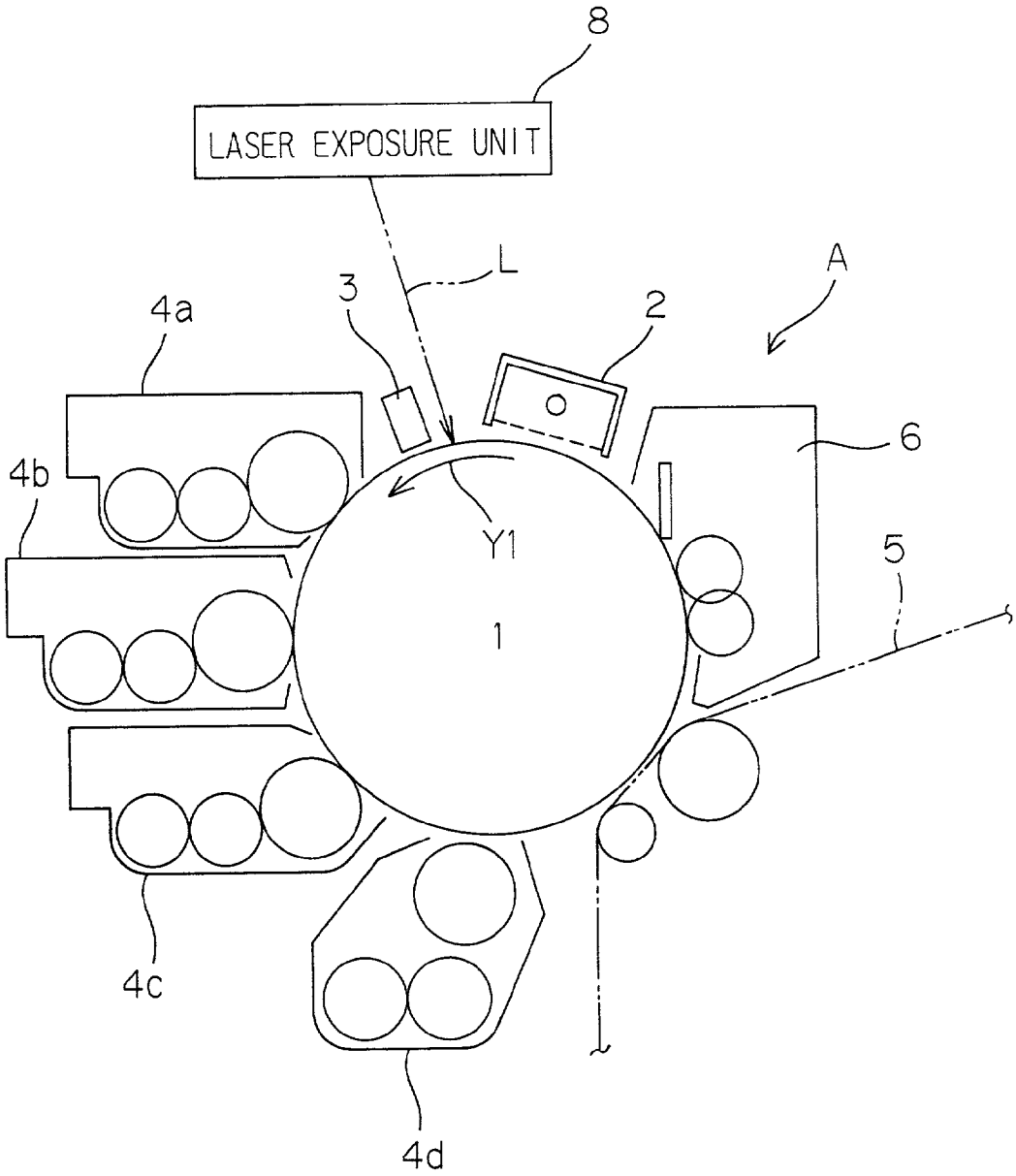
FIG. 4 is a view schematically illustrating the arrangement of an image forming apparatus A of a color digital copying apparatus.
Figure 5:
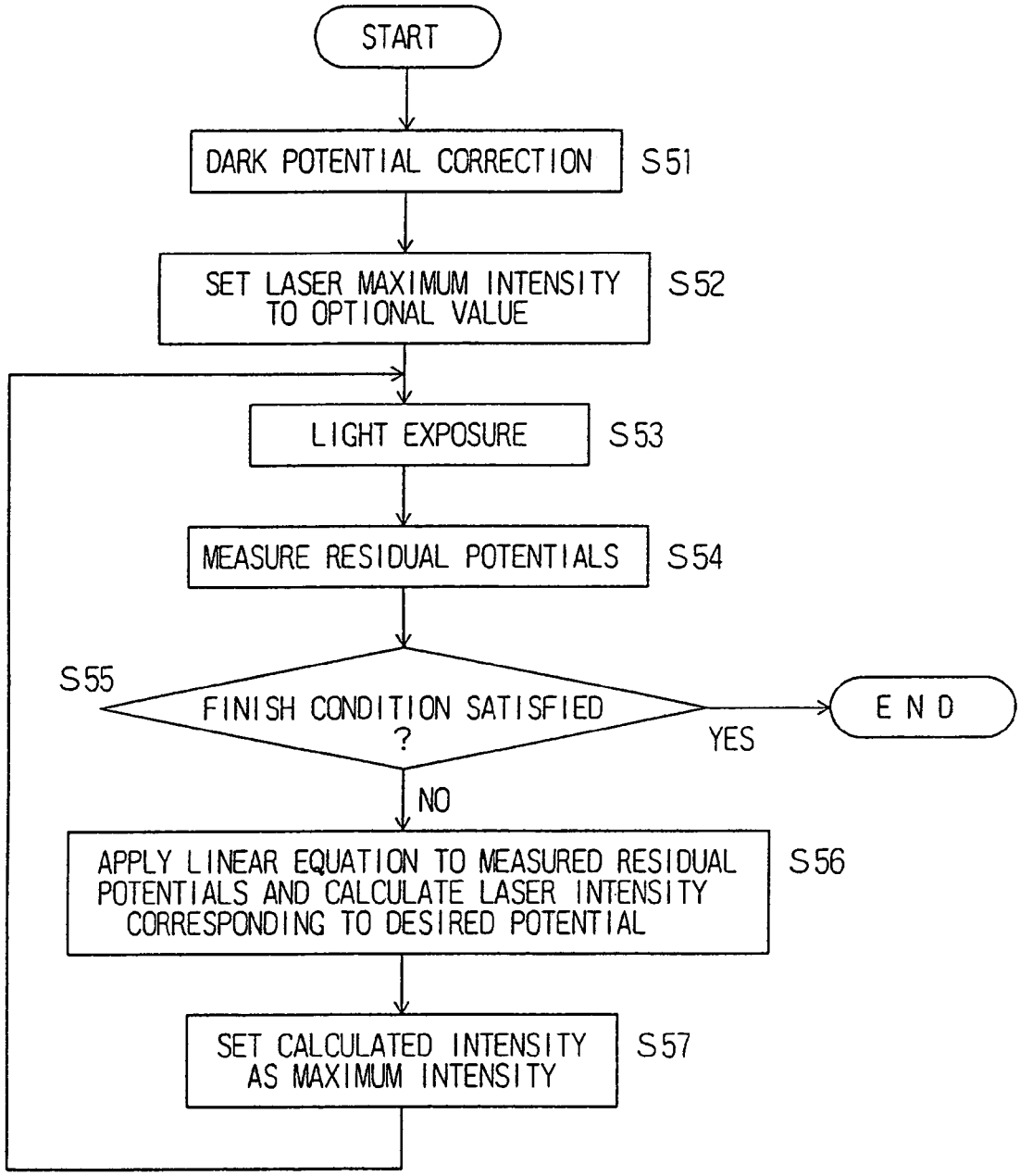
FIG. 5 (PRIOR ART)
FIG. 5 is a flow chart illustrating the operational procedure of a laser intensity adjusting method of prior art.
Figure 6:
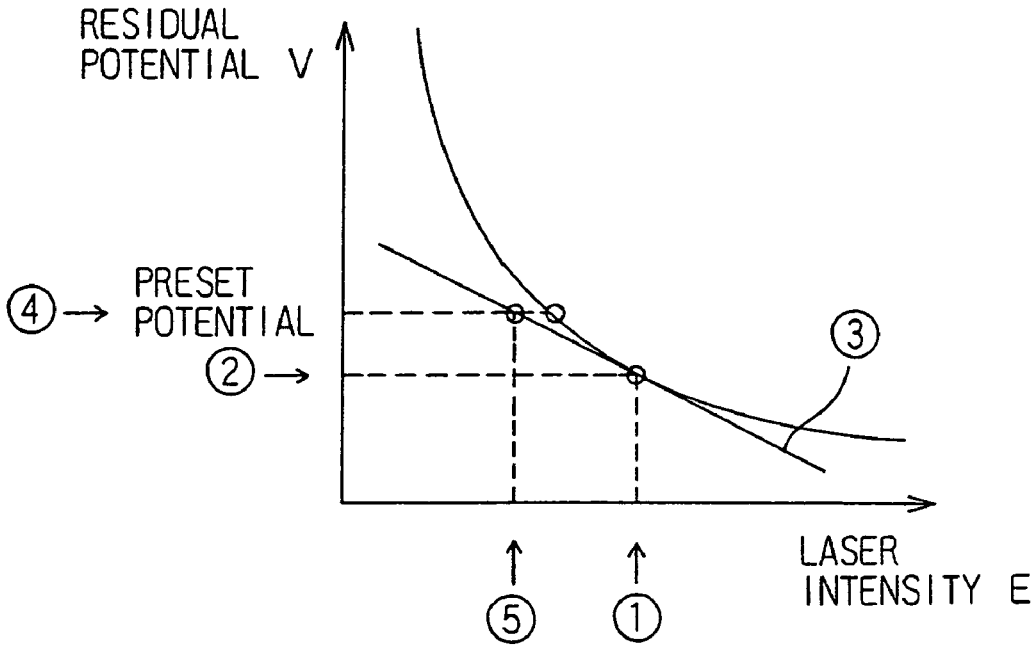
FIG. 6 (PRIOR ART)
FIG. 6 is a view illustrating the residual potential correction operation of prior art.

Likewise in the method of prior art above-mentioned, the description will be made, in this embodiment of the present invention, of a laser intensity adjusting method which is applied to an image forming apparatus A of a color digital copying apparatus as shown in FIG. 4.

The image forming apparatus A has at its center a drum-like photoreceptor 1. Disposed around the photoreceptor 1 are a corona discharger 2 for giving a predetermined uniform potential to the surface of the photoreceptor 1, a laser exposure unit 8 (of which laser light is shown by an arrow of L) for causing a surface portion of the photoreceptor 1 to be exposed to the laser light based on an image read by an image reading device (not shown), a potential sensor 3 for measuring the surface potential of the photoreceptor 1, developing units 4*a*–4*d* for developing an electrostatic latent image on the surface of photoreceptor 1 formed by its exposure to the laser light of the laser exposure unit 8 (the developing units 4*a*–4*d* arranged to respectively form toner images of yellow, cyanogen, magenta and black), a transferring belt 5 for transferring, to transfer paper, the toner images on the surface of the photoreceptor 1 formed by the developing units 4*a*–4*d*, and a cleaning unit 6 for cleaning residual toner remaining on the surface of the photoreceptor 1. These component elements above-mentioned are disposed in this order in the rotational direction of the photoreceptor 1 or in the direction of an arrow Y1.

The laser exposure unit 8 is arranged such that the laser maximum intensity can optionally be set and that the set maximum intensity ($P_{MAX}$) can be divided by a predetermined number (1023 in this embodiment) and laser light of each intensity ($P_{MAX}$×x/1023) (x=0, 1, 2, 3, . . . ) can be irradiated to the photoreceptor 1.

Referring to the flow chart in FIG. 1, the following description will discuss the operational procedure of the laser intensity adjusting method of the present invention.

In a manner similar to that in the prior art, dark potential correction is to be conducted (Step S1). More specifically, the bias voltage of the grid of the corona discharger 2 is set to an optional value, and with the photoreceptor 1 not exposed to the laser exposure unit 8, the potential (dark potential) of the photoreceptor 1 surface is measured by the potential sensor 3. Based on a difference between the measured dark potential and the desired preset potential, using a relationship equation (linear equation) obtained through experiments or the like, the bias voltage is adjusted such that the dark potential is equal to the desired preset potential.

In a subsequent residual potential correction, the maximum intensity $P_{MAX}$ of the laser exposure unit 8 is set (Step S2). This $P_{MAX}$ value is set somewhat high such that it will be higher than the final preset value (unknown). The maximum intensity $P_{MAX}$ thus set is divided by 1023 and some laser intensities are selected at relatively coarse intervals in a range which is considered to contain the final preset value (Step S3). For example, there may be selected five laser intensities $P_{MAX}$×(920/1023), $P_{MAX}$×(940/1023) $P_{MAX}$×(960/1023), $P_{MAX}$×(980/1023), and $P_{MAX}$×(1000/1023).

In succession, the surface of the photoreceptor 1 is exposed to laser lights of the laser intensities thus selected (Step S4). More specifically, exposure portions (patches A1~A5) are continuously formed, by the respective laser lights of laser intensities, on the surface of the photoreceptor 1 as shown in FIG. 2 for example. The potentials (residual potentials) of the respective patches are measured by the potential sensor 3 (Step S5). FIG. 3 shows an example of the measured potentials of the respective patches. The operations of steps S2–S5 correspond to a coarse-division potential detecting step or a first potential detecting step.

When there is found, in the measured residual potentials of the patches, potential equal to or substantially equal to the desired preset potential (that is, when a predetermined finish condition is satisfied) (YES at step S6), the laser intensity for the patch of which potential is equal to or substantially equal to the desired preset potential is adopted as the final maximum intensity, and the processing is finished.

On the contrary, when there is not found, in the measured residual potentials of the patches, potential equal to or substantially equal to the desired preset potential (that is, when a predetermined finish condition is not satisfied) (NO at step S6), some laser intensities at fine intervals are selected in the vicinity of the laser intensity for the patch of which potential is the nearest to the desired preset potential (Step S7). For example, it is now supposed that the desired preset potential is −200V and the patch A3 presents a residual potential of −198V. In such a case, a region lower than $P_{MAX}\times(960/1023)$ is further finely divided. For example, there are selected five laser intensities $P_{MAX}\times(950/1023)$, $P_{MAX}\times(952/1023)$ $P_{MAX}\times(954/1023)$, $P_{MAX}\times(956/1023)$, and $P_{MAX}\times(958/1023)$. Then, using these laser intensities thus selected, the operations of the steps S4–S6 are repeated. Thereafter, the step S7 and the steps S4–S6 are repeated until the finish condition is satisfied at the step S6. The step S7 and the steps S4–S6 correspond to a fine-division potential detecting step or a second potential detecting step.

When the finish condition is satisfied at the step S6, there is adopted, as the final maximum intensity, the laser intensity for the patch of which residual potential is equal to or substantially equal to the desired preset potential.

According to the laser intensity adjusting method of the embodiment having the arrangement above-mentioned, the photoreceptor 1 surface is exposed to laser lights of a plurality of laser intensities obtained by coarsely dividing an optionally set maximum intensity $P_{MAX}$, and the respective potentials are detected. When there is not obtained the desired preset potential, there are repeated operations of exposing photoreceptor 1 surface portions to laser lights of a plurality of further finely divided laser intensities and detecting the respective potentials, until there is obtained potential equal to or substantially equal to the predetermined set potential. Thus, no adjustment is made with the use of approximation, but the whole adjustment is made based on actually measured values, enabling an accurate residual potential correction to be readily made with a less number of iteration times.

An embodiment of the present invention has thus been discussed in detail, but this embodiment is a mere specific example for clarifying the technical contents of the present invention. Therefore, the present invention should not be construed as limited to this specific example. The spirit and scope of the present invention are limited only by the appended claims.

This application claims priority benefits under 35 USC Section 119 of Japanese Patent Application Serial No. H10-109782, filed on Apr. 20, 1998 with the Japanese Patent Office, the disclosure of which is incorporated herein by reference.

What is claimed is:

1. A laser intensity adjusting method of adjusting a maximum intensity of a laser exposure mechanism for irradiating laser light to a surface of a photoreceptor to which a uniform potential is being given by a corona discharger, said method comprising:

a first potential detecting step including the steps of (i) obtaining a first plurality of laser intensity values that increase from an initial value to a predetermined value according to a first interval to provide a first range of intensity values, (ii) successively exposing a surface portion of the photoreceptor surface with laser light having intensities corresponding to said first plurality of intensity values to provide a plurality of exposed patch portions on the photoreceptor surface, and (iii) detecting the potential of each of said plurality of exposed patch portions;

a second potential detecting step including the steps of (i) obtaining a second plurality of laser intensity values that increase from an initial value to a predetermined value according to a second interval to provide a second range of intensity values, said second interval being smaller than said first interval and said second range being smaller than said first range, (ii) successively exposing a surface portion of said photoreceptor surface with laser light having intensities corresponding to said second plurality of intensity values to provide a plurality of patch portions on the photoreceptor surface; and (iii) detecting the potential of each of said plurality of exposed patch portions; and a step of setting, as a maximum intensity of the laser exposure mechanism, a laser intensity with which there has been detected, at said first said second potential detecting step, a potential equal to or substantially equal to a predetermined set potential, wherein said laser intensities corresponding to said second plurality of intensity values are selected to be close to a laser intensity value corresponding to a potential detected during said first potential detecting step as closest to said predetermined set potential, and said second detecting step is repeated until there is obtained a potential equal to or substantially equal to said predetermined set potential.

2. A laser intensity adjusting method according to claim 1, wherein said laser intensity values obtained at first potential detecting step have values selected from a plurality of laser intensity obtained by dividing said predetermined laser intensity value of said first potential detecting step by a first predetermined number.

3. A laser intensity adjusting method according to claim 2, wherein said predetermined laser intensity value is set to a value which is greater than a suitable maximum intensity.

4. A laser intensity adjusting method according to claim 1, wherein said laser intensity values obtained at said second potential detecting step have values selected from a plurality of laser intensities obtained dividing said predetermined laser intensity value of said second potential detecting step by a second predetermined number.

5. A laser intensity adjusting method according to claim 3, wherein said predetermined laser intensity value is set to a value which is greater than a suitable maximum intensity.

6. A laser intensity adjusting method according to claim 1, wherein said exposed patch portions are spaced apart from each other on the photoreceptor surface.

7. A laser intensity adjusting method according to claim 6, wherein said exposed patch portions are generally rectangular areas on the photoreceptor.

* * * * *